US005194063A

United States Patent [19]

Kalm et al.

[11] Patent Number: 5,194,063

[45] Date of Patent: Mar. 16, 1993

[54] GARLAND MAKER

[75] Inventors: Celia Kalm; Owen McKimm, both of Arcadia, Calif.

[73] Assignee: Classico Manufacturing Company, Arcadia, Calif.

[21] Appl. No.: 743,016

[22] Filed: Aug. 9, 1991

[51] Int. Cl.[5] ..... B65H 49/18; B65H 51/02

[52] U.S. Cl. ..... 493/381; 493/468; 493/471; 493/958; 51/24; 51/203

[58] Field of Search ..... 493/346, 381, 468, 471, 493/958; 57/24, 203; 156/148

[56] References Cited

U.S. PATENT DOCUMENTS

| | | | |
|---|---|---|---|
| 449,038 | 3/1891 | Durr | 57/24 |
| 2,491,292 | 12/1949 | Wilmsen | 57/24 |
| 3,637,452 | 1/1972 | Sanders | 493/381 |
| 4,789,571 | 12/1988 | Kinderman | 493/958 |

FOREIGN PATENT DOCUMENTS

| | | | |
|---|---|---|---|
| 1009472 | 1/1950 | France | 57/24 |

*Primary Examiner*—Bruce M. Kisliuk
*Assistant Examiner*—Jack Lavinder
*Attorney, Agent, or Firm*—Christie, Parker & Hale

[57] ABSTRACT

A garland making device which comprises an arm rotatable about an axis formed by a stand securable to a work surface, the arm being rotatable by a crank. There is associated with and rotates simultaneously with the arm, a spool to feed a core cord or wire to an operator who adds sections of garland to the core at any desired rate of formation. The arm also provides and feeds from an independent source and by rotation of the arm wire which is wrapped by the arm around the foliage and core.

10 Claims, 3 Drawing Sheets

42
α
40
30
14
50
48
10
38
46
26
32
24
19
12
22
12
20
18
16

GARLAND MAKER

BACKGROUND OF THE INVENTION

Garlands are in essence, decorative ropes formed of natural and/or artificial foliage by sequentially stacking bunches of foliage in overlapping relation along a core line (cord or wire) and spiral wrapping the foliage with a binding line (wire or cord) to bind the foliage together and to the core. The foliage will normally range in length from 12 to about 36 inches with exposed stems of about 6 inches in length. As indicated, the foliage may be, whole or in part, fresh-cut, dried or artificial.

The garlands are typically made as decorative ornamentation used for weddings and parties and as house and office decoration during the Christmas holidays. Seasonal evergreens are the most widely used foliage.

The major problem with the garland is the cost of its assembly which has been a cumbersome hand operation. Formation of garlands have eluded mechanization.

Typically, the core line is laid along a work surface such as a table top and bunches of foliage serially laid along the core in overlapping relation. As foliage is progressively added to the core, the binding line is spirally wrapped around the added bunches of foliage binding them to one another and the core.

Given the cumbersome operation, production is at a rate limited to about 1 foot every 3 or more minutes. Real time is longer due to the fatigue involved in the assembly process and rest periods which must be taken.

It would be desirable to have a device which would enable a more rapid production of garlands in a trouble free fashion and this is the subject matter of the instant invention.

SUMMARY OF THE INVENTION

According to the present invention there is provided a garland making tool or device which comprises an arm rotatable about an axis formed by juncture of the arm to a stand securable to a work surface such as by a clamp, the arm being rotatable by means of a crank or other rotating means. There is associated with and rotated simultaneously with the arm, means to feed a continuous flexible core line formed of cord, wire or wire reinforced cord to an operator who adds sections of garland to the core at any desired rate of formation. The arm also provides and feeds from independent means rotated with the arm a binding line, normally wire, which is wrapped, by rotation of the arm around the foliage and core.

In the preferred embodiment the arm extends from one side of the stand and is rotated by a crank coupled to the arm at the opposed side of the stand. There extends from the arm means to support spools of line for forming the core and binding line for wrapping and binding the foliage to the core. The core line (cord or wire) is dispensed through a first conduit in the arm, substantially along the "center-line" of the garland. The binding line (wire or cord) is dispensed from a second conduit in the arm and is caused by rotation of the arm, to be spirally wrapped around bunches of foliage as they are added to the core.

Typically the rate of production is increased to a level of three or more feet per minute. In the preferred construction there is provided a cradle at which foliage, may be added to the core cord. This is a matter of convenience only but is utilized as a guide in the preferred construction of the invention.

In the construction core cord and wire are secured to free ends of stems of greenery to start the garland. The core cord is fed through a conduit which provides a core which is drawn away from the arm. The binding wire is simultaneously fed through the body of the arm and exits at the cradle and is wrapped around the foliage by rotation of the arm. In sum, greenery is added to the core as the garland is advanced in production, while rotation of the arm allows simultaneous dispensing of the core cord to form the center of the garland and addition of binding wire or cord spirally about the garland as it is formed.

DETAILED DESCRIPTION

Figure 1:
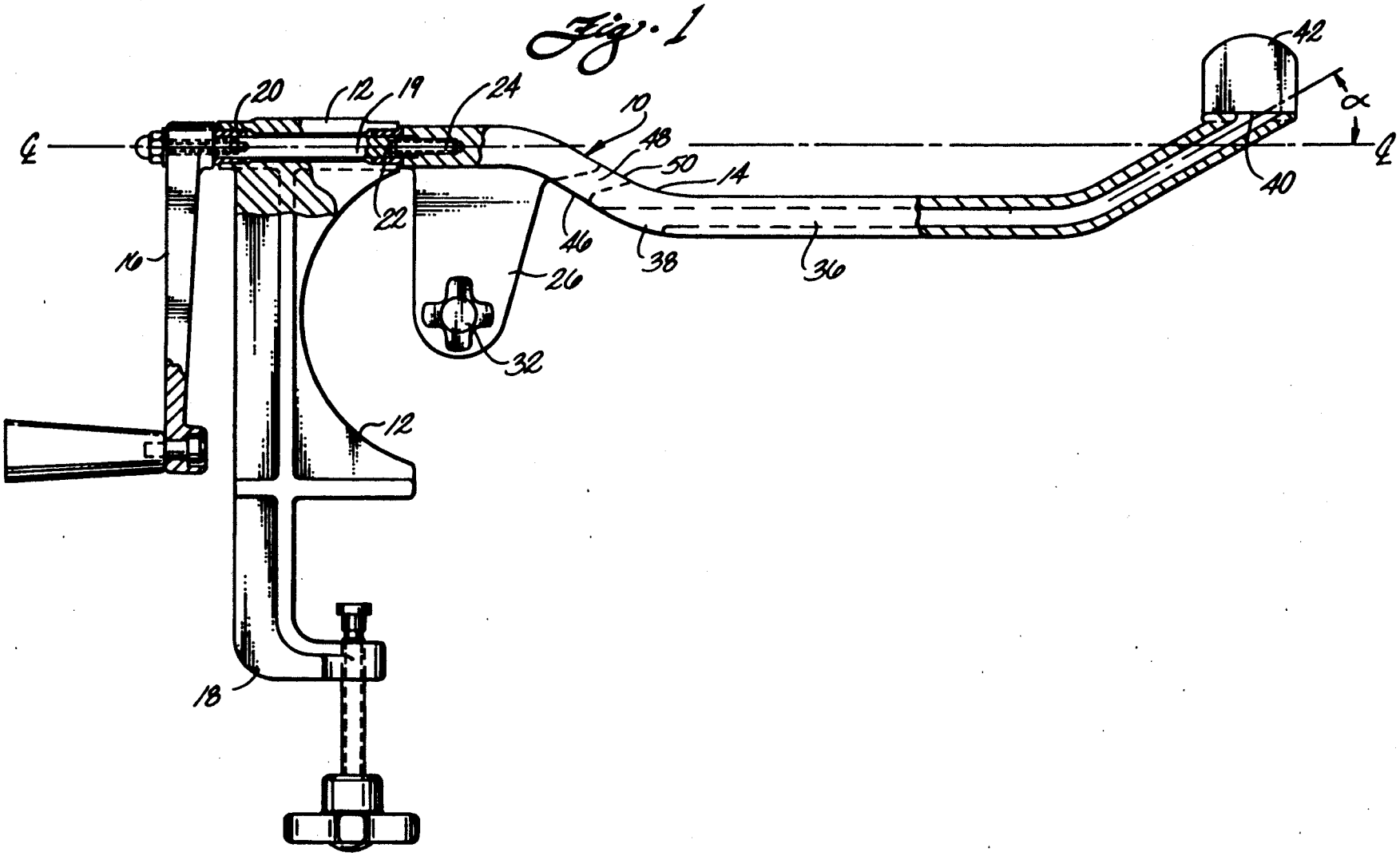
FIG. 1 is a side view of the garland maker of the instant invention showing cut-away sections illustrated for connection between the crank and the rotatable arm and conduit preferred means for dispensing core cord and binding wire.
Figure 2:
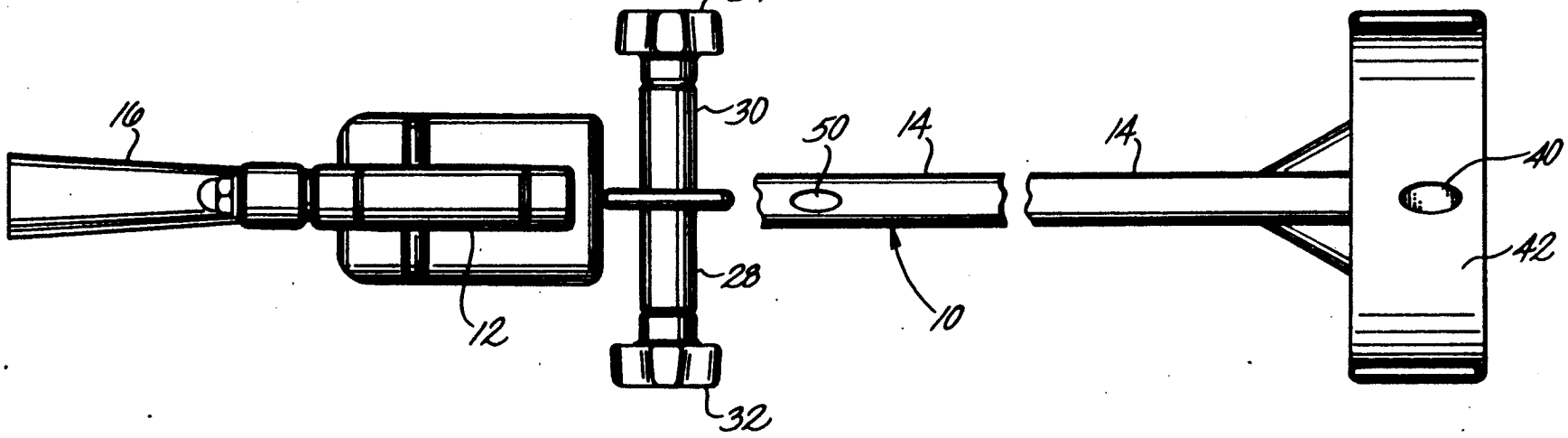
FIG. 2 is a top view of FIG. 1.
Figure 3:
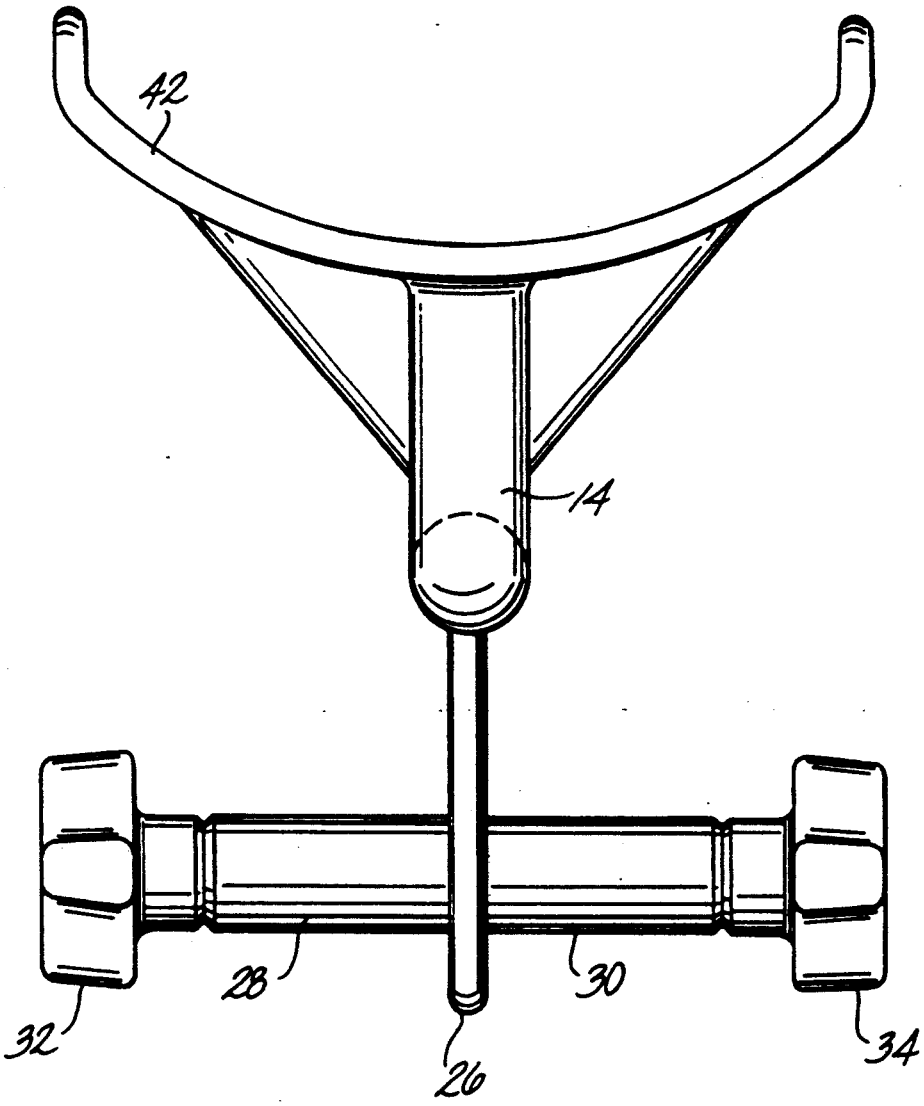
FIG. 3 is a front end view of the rotatable arm of FIG. 1.

The garland maker 10 of the instant invention, is illustrated in FIGS. 1, 2 and 3. FIG. 1 is a side view with cut-aways showing general elements of the construction. FIG. 2 is a top view of FIG. 1 and FIG. 3 is an end view of arm 14 looking to the discharge side of the garland make not showing mounting frame 12 which carries rotatable feed arm 14.

With reference to FIG. 1, the garland maker consists of a crank 16 to rotate feed arm 14 and includes means such as clamp 18 for securing the garland maker to a work surface such as a table top.

Crank 16 is coupled to arm 14 through shaft 19 at bearing 20, shaft 19 extending through sleeve bearings 20 and 22. Shaft 19 is in turn coupled by a screw connector 24 to arm 14. Extending from arm 14 is a retainer wall 26, having with reference to FIGS. 2 and 3 has extending therefrom, spool support shafts 28 and 30 adapted to respectively and interchangeably hold spools (not shown) of line in the form wire and/or cord. With reference to FIGS. 2 and 3 spools are retained on support shafts 28 and 30 by threaded knobs 32 and 34.

Arm 14 includes an internal conduit 36 for feeding line from a spool (not shown) mounted on shaft 28 or 30 through inlet opening 38 and outwardly from discharge opening 40 at cradle 42 for winding about an assemblage of cut foliage or greenery (not shown) added to the core line of a garland undergoing assembly.

Cradle 42 serves, if desired, the function of providing a rest for the garland undergoing assembly.

The core line, typically braided polypropelene cord, is fed simultaneously with a binding line, typically #20 or #22 wire, from spools mounted on shafts 28 and 30 and held on shafts 28 and 30 by knobs 32 and 34. The line is fed through opening 46 of conduit 48 and discharged outwardly from opening 50 for forming the central core of the garland.

As shown, the wire is fed from conduit 36 at an angle $\alpha$ to the axis of rotation or center line ( ℄ ) formed by the junction of arm 14 to stand 12. The angle is acute in respect of the axis of rotation and line of discharge of core line from conduit 48.

Greenery being formed into a garland is added at cradle 42 and typically presented beyond opening 40 of cradle 42 with rotation of the crank 16 which rotates arm 14, the cooperation causing simultaneously dispensing of core line and wrapping of wire around greenery forming the garland. Rate of assembly is three or more feet per minute. Knobs 32 and 34 retain spools of cord and wire on shafts 28 and 30 extending from retaining wall 26.

The garland suitably wrapped with wire and cord is allowed to form, in a generally rope shape, to any desired length. When the process is complete, the adding of greenery is terminated and the wire and cord cut and tied together.

As will be appreciated, the unique feature of this invention is the simultaneous rotation of spools of wire and cord around the greenery being urged from cradle 42 of the garland maker thus eliminating any possibility of wire and cord becoming tangled. Assembly of greenery into a useful decorative item occurs at a cost substantially less than current methods of handmaking garlands.

As will be appreciated that modifications may be made to the invention without departing from its spirit. The locations of the conduits 36 and/or 48 can be changed for convenience as long as there is non-obstructed ability to pass wire and cord through arm 14 for wrapping about greenery in garland formation. Springs or the like may be provided with the spools to add tension to the spools of wire and/or cord to prevent a free running during the feed of wire and cord. If desired, crank 16 may be substituted by a motorized drive or the like to eliminate hand turning during the feed operation. Materials for construction are typically metal with aluminum casting being used. Conduits may be lined with wear resistant metals for long life.

What is claimed is:

1. A garland maker comprising:

a) an elongated rotatable longitudinal arm having a longitudinal axis providing:

i) first conduit means for directing a first line from a first source of line securable to and rotatable with said arm at a maximal end of the arm for providing a core of a garland undergoing assembly;

ii) second conduit means for directing a second line from a second source of line securable to and rotatable with said arm at said proximal end of the arm for spirally wrapping said second line around bunches of foliage placed on the line forming the core by rotation of said elongated rotatable arm and said second conduit means extending longitudinally through substantially the entire length of the arm, said second conduit means having an opening approximate the proximal end of the arm for receiving said second line, and having an opening of a distal end of the arm for discharging the second line from the second conduit means;

b) support means for to securing the garland marker to a work surface, said support means receiving said arm at a junction and in rotatable relation thereto;

c) means at said proximal end of the arm to rotate said rotatable arm about an axis of rotation spaced from the longitudinal axis of said rotatable arm, said axis of rotation defined by said support and a portion of said rotatable arm whereby when said first line and second line are respectively simultaneously dispensed through the first and second conduits in said arm, said first line forms the core line of a garland and said second line binds foliage to said core line by rotation about the core line to form a continuous length of garland.

2. A garland maker as claimed in claim 1 in which the first line comprises a cord and the second line comprises wire.

3. A garland maker as claimed in claim 1 in which the second conduit extends along the length of the arm from a point forward of the second source of line substantially to the end of said arm.

4. A garland maker as claimed in claim 3 in which the second conduit discharges the second line at an acute angle to the axis of rotation and at an angle to the direction of feed of first said line from the first conduit means.

5. A garland maker as claimed in claim 4 including a guiding cradle is provided at an end of the arm opposed the junction of the arm with support means.

6. A garland maker comprising:

a) a rotatable generally arc shaped elongated arm having a longitudinal axis providing a first conduit for dispensing a first line for use as the core of a garland and a second conduit running substantially the length of said arm for dispensing a binding line for wrapping about garland foliage and the core by rotation of said elongated arm having the longitudinal axis;

b) wall means secured to said rotatable arm providing a first shaft means for supporting a spool of line for dispensing to and through said first conduit a first line for use as a core and a second shaft means for supporting a spool of line for use in dispensing a second line as a binding line through said second conduit;

c) stand means for securing to a work surface and supporting said arm in rotary relation to said stand means to form a centerline about which the longitudinal axis of the elongated rotatable arm rotates while core and binding line ar dispensed;

d) means to rotate said arm relative to said stand means and to simultaneously dispense said first line for the core and said second wrapping line for spirally wrapping said second line in binding relation about combined foliage and core.

7. A garland maker as claimed in claim 6 in which the first line comprises a cord and the second line comprises wire.

8. A garland maker as claimed in claim 6 in which the second conduit extends along the length of the arm from a point forward of the second source of line substantially to the end of said arm.

9. A garland maker as claimed in claim 6 in which the second conduit discharges said second line at an acute angle to the axis of rotation and at an angle to the direction of feed of first line from the first conduit means.

10. A garland maker comprising:

a) a stand for securing said garland maker to a work surface and coupled to an arm extending an axis formed by a rotating intersection of said arm with said stand;

b) a generally arc shaped arm extending from one end of said stand in a first direction away from the axis thereof and then back towards said axis at an opposed end;

c) a wall having opposed surface extending outwardly from said arm adjacent to the intersection of said arm to said stand;

d) first and second shaft means extending from each of the opposed surfaces of said wall and respectively for supporting and retaining spools of line;

e) a first conduit extending through the arm adjacent to said wall and for receiving a line contained on said first shaft means and dispensing said line as a core for a garland undergoing assembly;

f) a second conduit extending from a point adjacent said wall means internally of the length of said arm for providing an opening to discharge binding line dispensed from a spool on said second shaft means the on end of the arm opposed to the stand and to spirally wrap, with relation of said arm, binding line at an angle to the core tire about bunches of foliage added to said core line;

g) cradle means positioned on the end of the arm opposite the stand to guide addition of foliage to said core;

h) means to cause rotation of said arm relative to said support.

* * * * *

UNITED STATES PATENT AND TRADEMARK OFFICE

CERTIFICATE OF CORRECTION

PATENT NO. : 5,194,063

DATED : March 16, 1993

INVENTOR(S) : Celia Kalm; Owen McKimm

It is certified that error appears in the above-identified patent and that said Letters Patent is hereby corrected as shown below:

Column 2, line 33, change "make" to -- maker --.

Column 3, line 23, change "As" to -- It --

Column 3, line 43, change "maximal" to -- proximal --.
Column 3, line 57, after "opening" change "of" to -- at --.
Column 3, line 60, before "securing" delete "to".
Column 3, line 60, change "marker" to -- maker --.

Column 4, line 43, change "ar" to -- are --.
Column 4, line 62, after "extending" insert -- along --.

Column 6, line 3, change "the on" to -- to an --.
Column 6, line 4, change "relation" to -- rotation --.
Column 6, line 5, before "about" change "tire" to -- line --.

Signed and Sealed this

Fifteenth Day of March, 1994

*Attest:*

Bruce Lehman

BRUCE LEHMAN

*Attesting Officer*

*Commissioner of Patents and Trademarks*